US007950921B1

(12) United States Patent
Woolsey

(10) Patent No.: US 7,950,921 B1
(45) Date of Patent: May 31, 2011

(54) METHOD AND APPARATUS FOR COOLING THE UNDERSIDE OF KILN CARS

(75) Inventor: Rick L. Woolsey, Olathe, KS (US)

(73) Assignee: Solution Dynamics, LLC, Paola, KS (US)

( * ) Notice: Subject to any disclaimer, the term of this patent is extended or adjusted under 35 U.S.C. 154(b) by 480 days.

(21) Appl. No.: 12/176,353

(22) Filed: Jul. 19, 2008

Related U.S. Application Data

(60) Provisional application No. 60/961,285, filed on Jul. 20, 2007.

(51) Int. Cl.
*F27D 15/02* (2006.01)

(52) U.S. Cl. ..... 432/77; 432/234; 432/128

(58) Field of Classification Search ..... 432/77, 432/78, 121, 128, 233, 234
See application file for complete search history.

(56) References Cited

U.S. PATENT DOCUMENTS

| | | | | |
|---|---|---|---|---|
| 1,867,122 | A * | 7/1932 | Watts | 432/77 |
| 4,069,010 | A * | 1/1978 | Fay | 432/137 |
| 4,722,682 | A | 2/1988 | Lingl, Jr. | |
| 4,744,750 | A | 5/1988 | Lingl, Jr. | |
| 4,778,384 | A | 10/1988 | Lingl, Jr. | |
| 4,990,086 | A * | 2/1991 | Eustacchio | 432/133 |

* cited by examiner

*Primary Examiner* — Gregory A Wilson
(74) *Attorney, Agent, or Firm* — Erickson, Kernell, Derusseau & Kleypas, LLC

(57) ABSTRACT

An improved method and apparatus for cooling the under-car channel of a tunnel kiln while minimizing migration of air between the above-car and under-car channels involves controlling or equalizing the mass flow of cooling air directed through the under-car channel and in particular through individual undercarriage cooling zones which can match individual heating zones of the tunnel kiln.

8 Claims, 6 Drawing Sheets

METHOD AND APPARATUS FOR COOLING THE UNDERSIDE OF KILN CARS

CROSS REFERENCE TO RELATED APPLICATIONS

This application claims the benefit of the prior filed, co-pending application Ser. No. 60/961,285 filed Jul. 20, 2007.

FIELD OF INVENTION

This invention is directed to a method and apparatus for cooling the undersides (under-car channels) of kiln cars carrying a load of material to be heated through a tunnel type kiln. The apparatus and method of the present invention focus on equalizing the mass flow rate of the supply air and exhaust air through the system and in particular through individual temperature control zones which match the individual heating zones of the tunnel kiln.

BACKGROUND OF THE INVENTION

Tunnel kilns are elongated kilns through which a train of kiln cars is advanced to heat or fire ceramic materials, such as bricks, supported on the kiln cars. The kiln car train typically travels on rails running through the tunnel. The material to be heated is supported on a flat deck which in turn is supported on an undercarriage with wheels which travel on the rails. It is known to cool the underside of tunnel kiln cars, such that the support and transport mechanisms are maintained in a relatively cooler atmosphere than the upper deck side. Cooling of the underside of the kiln cars is utilized to avoid overheating the undercarriage, wheels, bearings and the like located beneath the deck of the kiln cars.

The kiln tunnel is generally separated into an under-car tunnel area or channel and an above-car tunnel area or channel by the deck of the kiln cars and one or more mechanical seals connected to or associated with the kiln car decks. The seals function to attempt to keep heated and cooled air in their respective areas, such that heated air does not migrate from the above-car channel to the below-car channel and cooling air does not migrate from the under-car channel into the above-care channel and have to be heated to process temperatures. These mechanical seals are specifically necessary to prevent infiltration and ex-filtration of air into and out of the above-car channel as the primary kiln exhaust fan, typically located toward the kiln tunnel entrance, keeps a relatively negative pressure in the above-car channels, which are heated to process temperatures.

One conventional and sometimes additional method for sealing the moving kiln car sides to the kiln side walls is to provide aprons along the longitudinal car sides which dip into sand filled channels of the kiln side walls such that the sand forms a closed barrier extending the length of the kiln. Transverse joints between successive kiln cars may be sealed by means of conventional mechanical joints and elastic material cords. The purpose of such mechanical seals and sand barriers is to substantially prevent pressure equalization between the under-car channel and the heated above-car channels, the seals are far from perfect. For design and cost reasons, the depth to which aprons can dip into the sand must be relatively small. Additionally, the sand must be fairly coarse so that it will be heavy enough so as not to be blown out of the channel barrier area and entrained in the moving gas flows. As a result, the sand barrier actually is permeable to gas and does not provide a perfect seal. Mechanical and elastic material seals simply wear out and degrade from the excessive kiln temperatures and also do not provide a perfect seal.

An established method of cooling the under-car channel is forcing air through the under-car channel at each of the various heating zones in the tunnel kiln. A disadvantage of this method is that a portion of the forced air will penetrate the mechanical seals and then the cooling air will have to be heated to very high process temperatures. A second method of cooling the under-car channel is forcing air into the under-car channel from the exit end of the tunnel kiln toward its entrance end, which may or may not be practiced with a secondary under-car exhaust fan located toward the kiln entrance which draws air from the under-car channel. This second method also has a disadvantage in that a portion of the forced air will penetrate the mechanical seals and then the cooling air will have to be heated to very high process temperatures.

A third method is to use openings in the foundation or side walls of the under-car channel to allow natural cooling of the under-car channels. This third method also has a disadvantage in that a portion of the natural cooling air will penetrate the mechanical seals and then the cooling air will have to be heated to very high process temperatures. The cooling air penetration in all three cases of the known prior art is partially caused by imperfect and worn mechanical seals, misaligned seals caused by natural degradation of the tunnel kiln structure, and the negative pressure within the above-car channel caused by the kiln exhaust fan, i.e. a pressure imbalance between the under-car channel and above-car channel.

The above-car channel is typically filled with air, combustion products, and off gases (collectively gases) from the heating process and curing process from the ceramic materials. These gases are typically flowing the same direction as the under-car cooling air, such that a pressure gradient develops in both channels. Because there are different gas flow rates and resistances in the above-car and under-car channels, the pressure gradient is different as a function of distance along the tunnel thereby leading to "false" air flows between the two channels, usually in the form of air moving from the under-car channel to the above-car channel. The air flows between the two channels (infiltration into the above-car channel and ex-filtration from the under-car channel) must be avoided in order to avoid undue heating of the under-car channel or undue cooling of the above-car channel and the related excess energy usage to heat the infiltrated air from under-car channel.

In prior art it is also known that there may be multiple trains of kiln cars traveling parallel to one another in side-by-side fashion. Such a kiln may or may not have intermediate longitudinal walls located between adjacent kiln car trains. Such kiln cars are typically equipped with the same conventional sand seals, i.e. aprons described above which dip into sand filled channels disposed laterally of each train. The problems associated with this conventional "sand trough" sealing technique for multi-train kilns are simply an order of magnitude larger than those experienced with a single train kiln. For example, long lateral distances are needed between adjacent kiln car trains to accommodate the required volume of sand in the channels in order to seal each of the multiple trains. The long lateral distances and required structure disrupt the gas flow conditions existing in the firing channel. Also, the increased number of sand-sealed channels in multi-train kilns tunnels increases the infiltration into the above-car channels from the under-car channels, making it more difficult to heat the above-car channel and the material on the car. For these reasons, multi-train tunnels are not generally constructed for commercial use.

It would be advantageous if a kiln tunnel could be provided which minimizes "leaks" between the above-car channel and under-car channel while providing balanced under-car cooling. It would be further advantageous to develop such a system which could be utilized with multi-train or multi-track tunnels.

SUMMARY OF THE INVENTION

The improved method and apparatus for cooling the under-car channel of a tunnel kiln while minimizing migration of air between the above-car and under-car channels involves controlling or equalizing the mass flow of cooling air directed through the under-car channel and in particular through individual temperature control zones which match the individual heating zones of the tunnel kiln.

Cooling air is supplied to each section or zone of the under-car channel from a blower through a main supply duct or supply trunk and branched supply ducts connected to each zone. For each branch supply air duct, there is a branch exhaust air duct serving the same zone of the under-car channel and connected to an exhaust fan through an exhaust trunk or main exhaust duct. The supply air volume provided to each section or zone of the under-car channel is regulated with an adjustable air flow damper that is modulated according to the necessary air flow that is required to maintain the exhaust air from the under-car channel and zone at a given set point, such as 350° F. The branch exhaust air ducts are likewise equipped with adjustable air flow dampers. Temperature transducers in each zone or section communicate the detected temperatures to a controller which then controls the dampers to increase or decrease the mass flow rate of cooling air through the respective zones to achieve the desired level of cooling.

The methodology and apparatus disclosed herein are also applicable to multi-train kiln tunnels to provide a significantly improved seal between the above-car channel firing and under-car channel cooling without an intermediate continuous wall positioned between adjacent kiln car trains. Therefore, the distance between adjacent kiln car trains can be maintained at an acceptably small dimension. Also, the improved methodology is applicable to multi-train kiln tunnel kilns that use narrow kiln cars customarily associated with older multi-train tunnel kilns with minimal conversion thereof. The improved under car cooling system disclosed herein may also be used with a multilane tunnel kiln having a longitudinal pedestal positioned between adjacent kiln car trains. This pedestal may incorporate one or more mechanical seals described above. Therefore, the mass flow controlled under-car cooling can be accomplished in a multi-train tunnel kiln employing the techniques described herein.

Individual sub-chambers may be cooled differently as a function of prevailing temperature within that specific sub-chamber. For example, a first firing zone may have a different cooling air mass flow than a second firing zone and the mass flow of the under-car cooling air can be controlled for each specific sub-zone as required by the process parameters required in the respective above-car channels. With the balanced mass flow approach, there is no substantial gas flow into or out of the sub-chamber other than cooling air. Therefore, there is no substantial leakage gas flow between the cooling channel and the firing channel. As a result, the leakage rates of sand filled channels or other types of mechanically attempted "perfect" seals between the above-car firing channel and the under-car cooling channel are much more effective in that the leakage rates are substantially reduced, thereby increasing the net kiln energy efficiency. As an added advantage, the under-car channel individual zones can be cooled at different rates in different sections or sub-chambers as a function of position along the tunnel kiln. Kiln cars can be transported along a rail system in the same plane both inside and outside the tunnel kiln so that lifting or lowering devices are avoided when wet seals are used. This under-car cooling system substantially facilitates movement and circulation for the kiln cars with conventional apparatus and existing facilities which can be retrofitted or converted to practice this present invention.

BRIEF DESCRIPTION OF ACCOMPANYING DRAWINGS

DETAILED DESCRIPTION OF INVENTION

Figure 1:
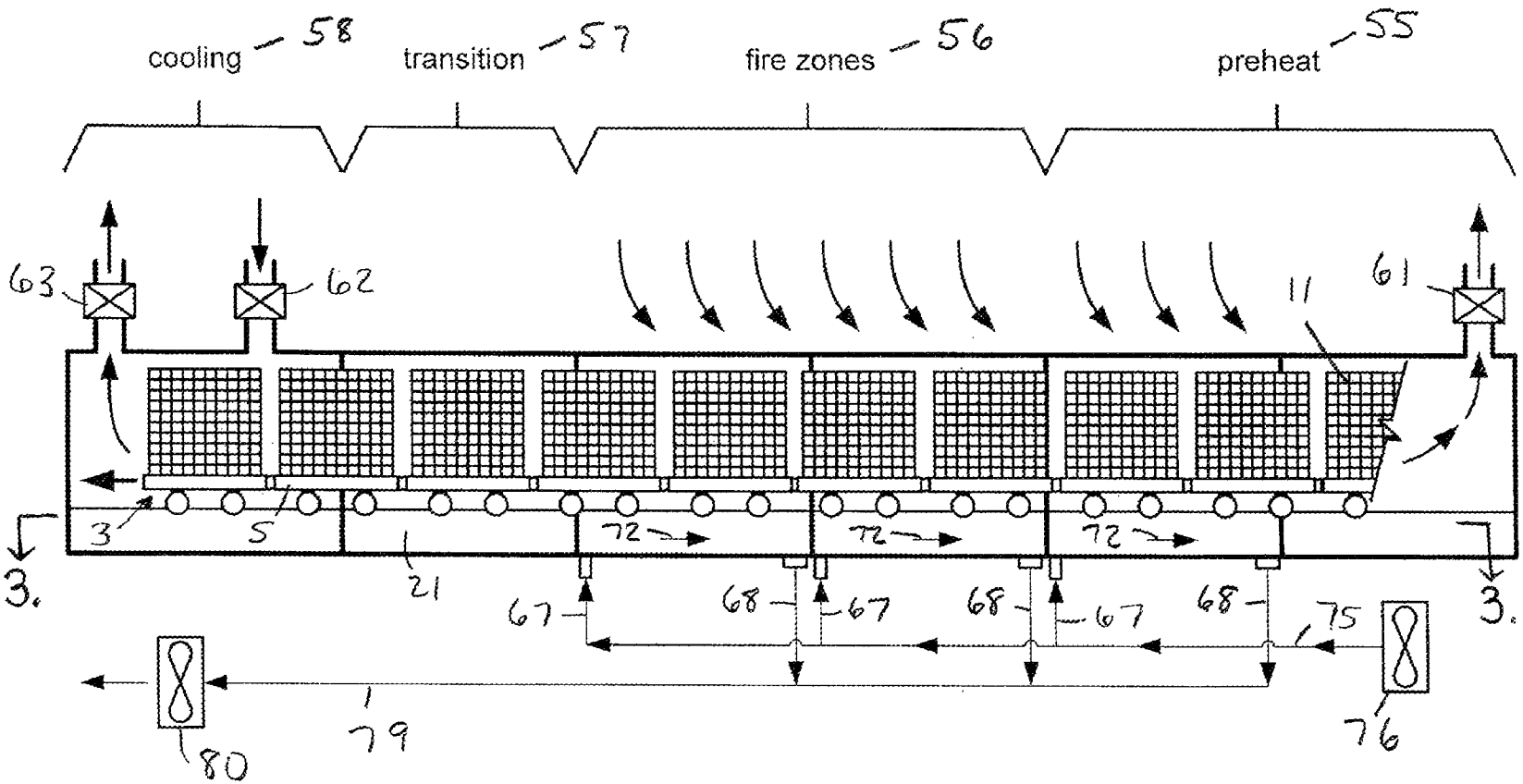
FIG. 1 is a schematic longitudinal cross-sectional view through a tunnel kiln showing a kiln car train passing through an inlet zone, preheat zone, firing zone, transition zone and cooling zone and an improved under-carriage cooling system for kiln cars.
Figure 2:
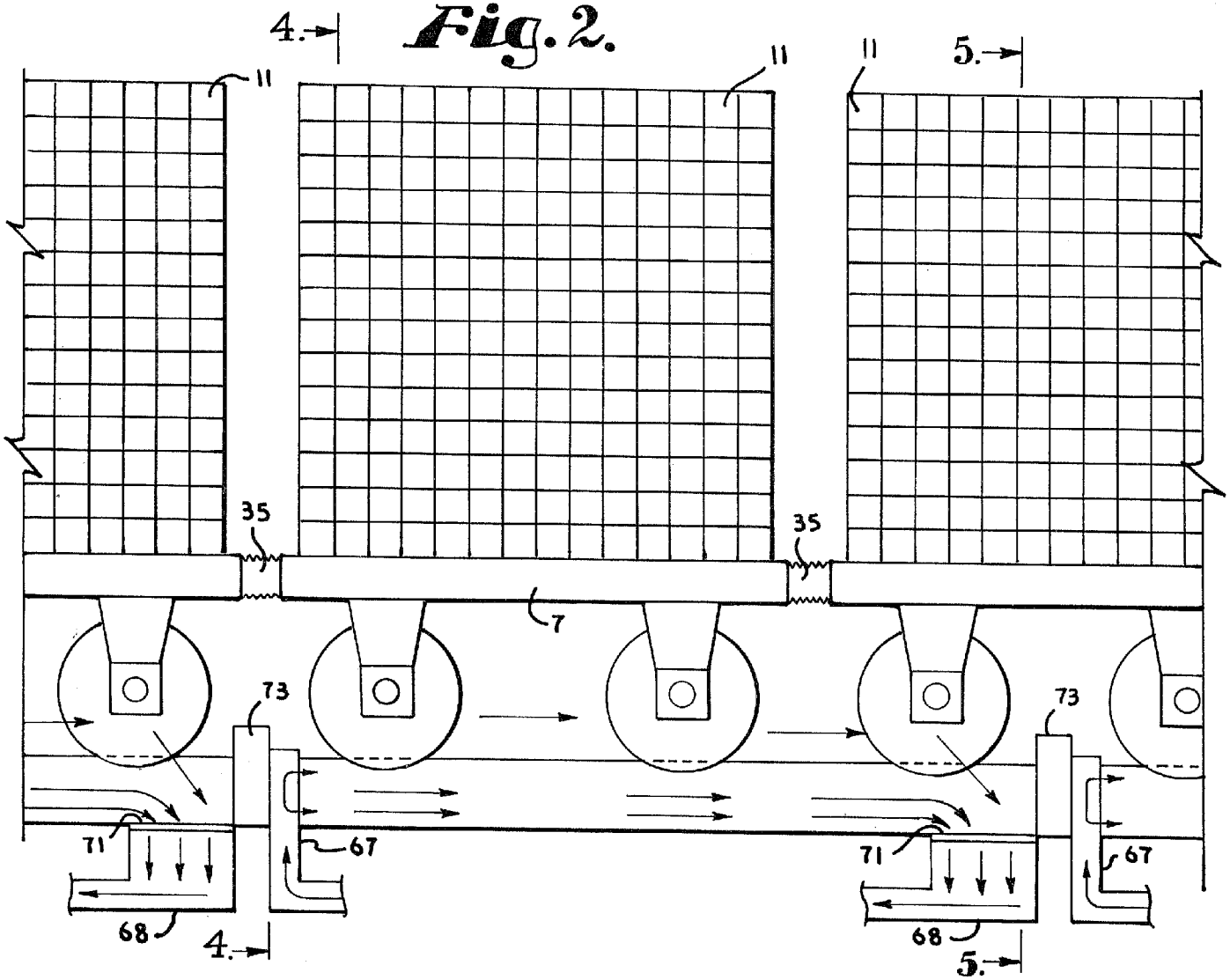
FIG. 2 is an enlarged and fragmentary schematic cross-sectional view through the tunnel kiln of FIG. 1 showing kiln cars of the kiln car train supporting bricks and showing additional details of the under-carriage cooling system.

Referring to the drawings in more detail, a schematic view of a tunnel kiln 1 with a kiln car train 3 passing therethrough is shown in FIG. 1. The kiln car train 3 comprises a plurality of kiln cars 5 coupled together in end to end alignment. Referring to FIG. 2, which is an enlarged and fragmentary view of the kiln car train 3 in the tunnel kiln 1. Each of the kiln cars 5 includes a deck 7 supported by an undercarriage 9. Articles to be cured, such as bricks 11, are stacked on and supported by the deck 7 and the undercarriage facilitates passage of the kiln car 5 through the tunnel 1. An undercarriage cooling system 13 is incorporated into the tunnel kiln 1 to cool the undercarriages 9 of the kiln cars 5 as the train 3 passes through the tunnel kiln 1. It is to be understood that the drawings provided, including schematic views, are not drawn to scale and relative proportions have been modified to allow the drawings to fit the space provided. In addition, the relative proportions of individual elements in the drawings may vary from figure to figure.

Figure 4:
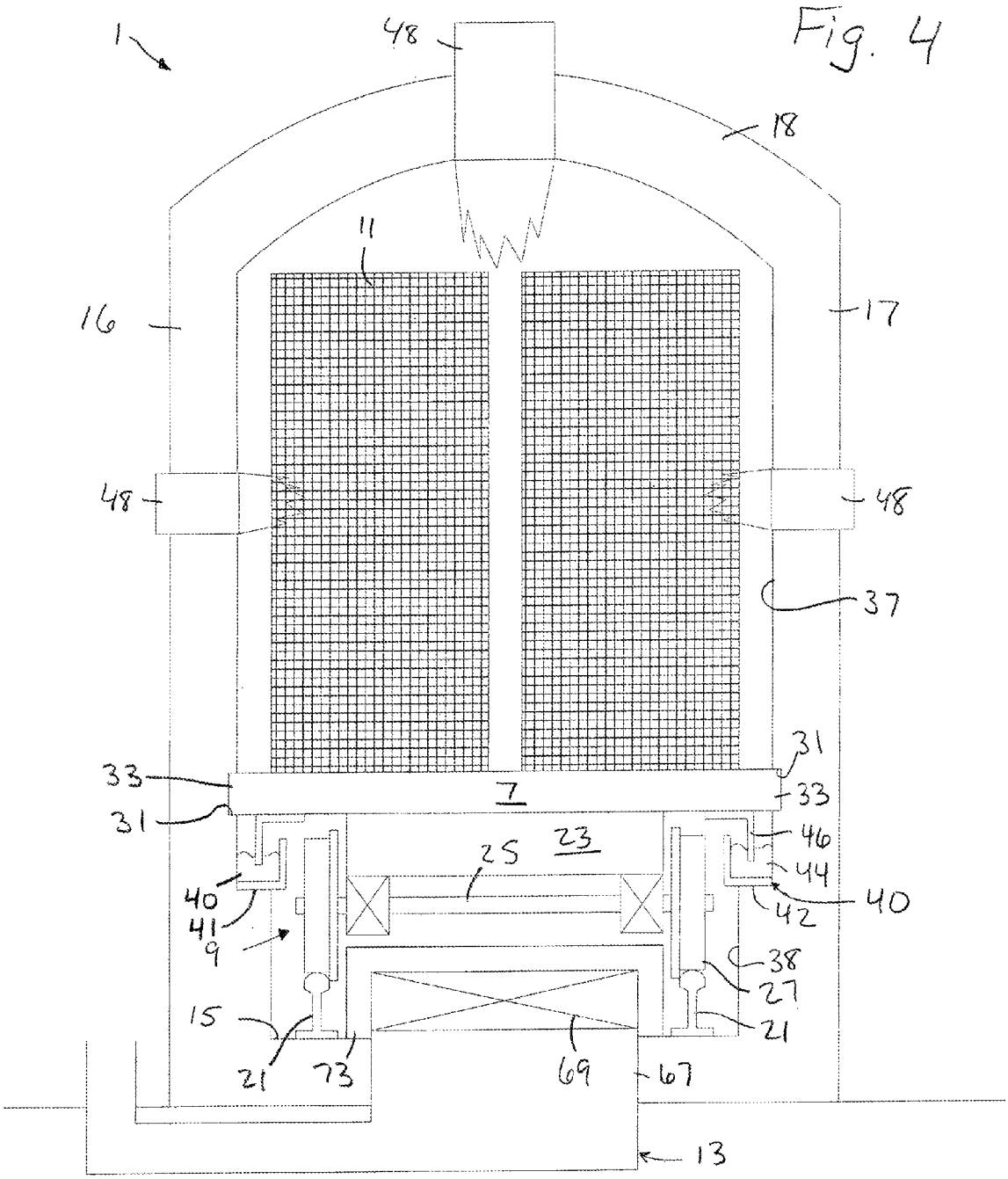
FIG. 4 is a schematic cross-sectional view taken along line 4-4 of FIG. 2.
Figure 5:
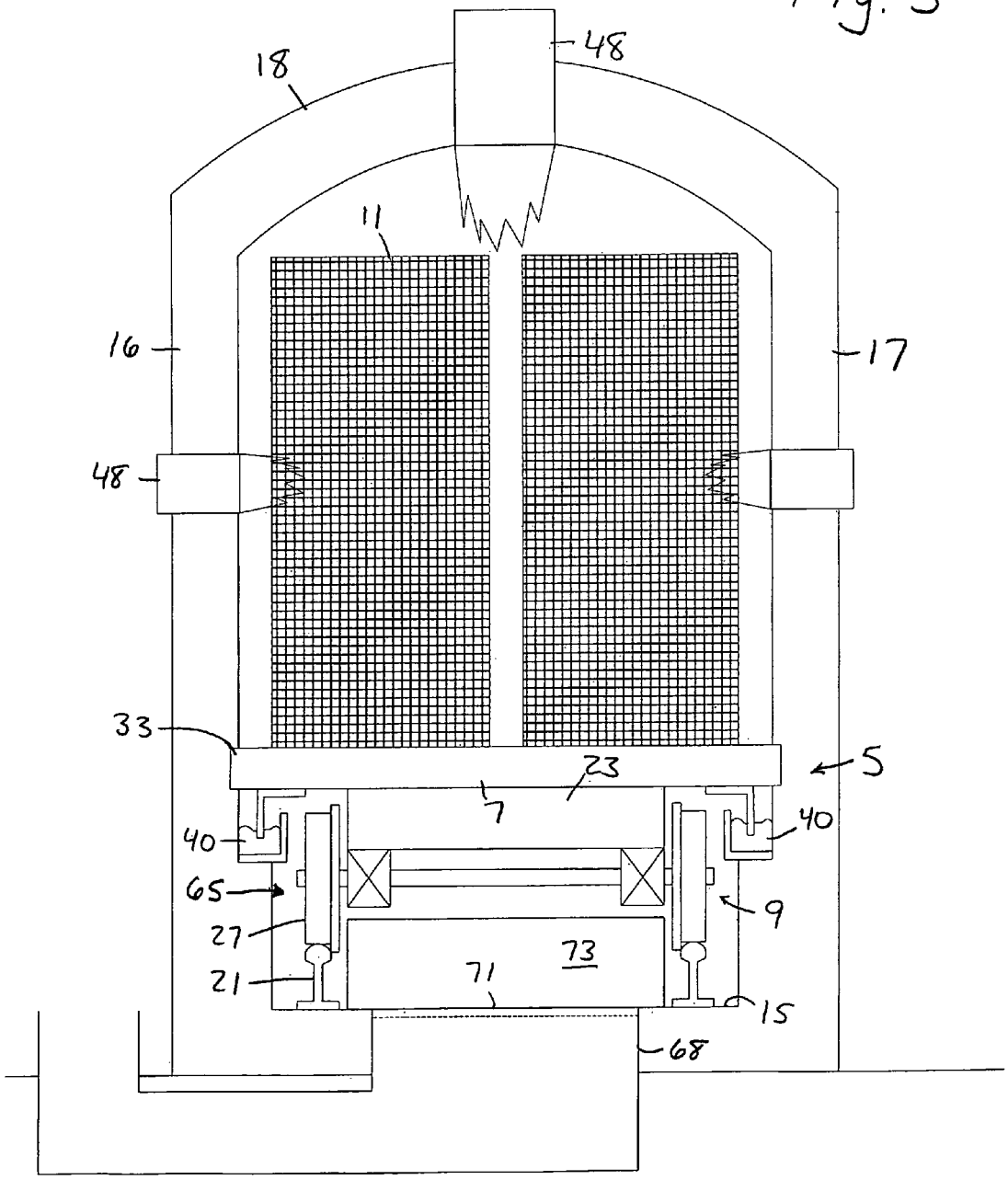
FIG. 5 is a schematic cross-sectional view taken along line 5-5 of FIG. 2.

As best seen in FIG. 4, the tunnel kiln 1 generally comprises a floor or base 15, opposed sidewalls 16 and 17 and a roof or top 18. A pair of rails 21 form a track extending through the tunnel kiln 1. The kiln 1 shown in FIG. 4, includes a single track and the walls are spaced apart a distance to allow a single train 3 of kiln cars 5 to pass therethrough. It is to be understood however, that the undercarriage cooling system of the present invention could be adapted for use in kilns incorporating multiple tracks laid side to side. The undercarriage 9 of each kiln car 5 generally includes axle supports 23, which include axle bearings, depending from the deck 7 and supporting a pair of axles 25, each axle 25, having a pair of flanged wheels 27 mounted thereon.

Referring again to FIG. 4, the tunnel kiln 1 may be of the type having recesses or grooves 31 formed in each sidewall 16 and 17 and sized to receive sides 33 of each deck 7 of the kiln cars 5. Extension of the sides 33 of the kiln car decks 7 into the sidewall grooves forms a partially effective mechanical seal to prevent transfer of air across either side of the deck 7. Flexible seals 35 are also preferably formed between each kiln car 5 and may or may not be formed between the sides 33 of the kiln car decks 7 and the kiln sidewalls 16 and 17. The space in the tunnel 1 above the decks 7 may be referred to as the upper kiln tunnel channel 37 and the space in the tunnel 1 below the decks 7 may be referred to as the lower kiln tunnel channel 38 or the upper zone 37 and lower zone 38 respectively.

An additional sealing means for forming a seal between the upper and lower zones 37 and 38 is the use of a sand seal 40 extending along both sidewalls 16 and 17. More specifically troughs 41 and 42 extend along the length of each sidewall 16 and 17 below the grooves 31 therein for receiving the deck sides 33. The troughs 41 and 42 are filled with sand 44. Aprons 45 and 46 depending from the deck 7 of each rail car on opposite sides thereof extend into the troughs 41 and 42 respectively and into the sand contained therein to create a seal to reduce airflow thereacross and between the upper and lower zones 37 and 38 of the tunnel kiln 1.

Figure 3:
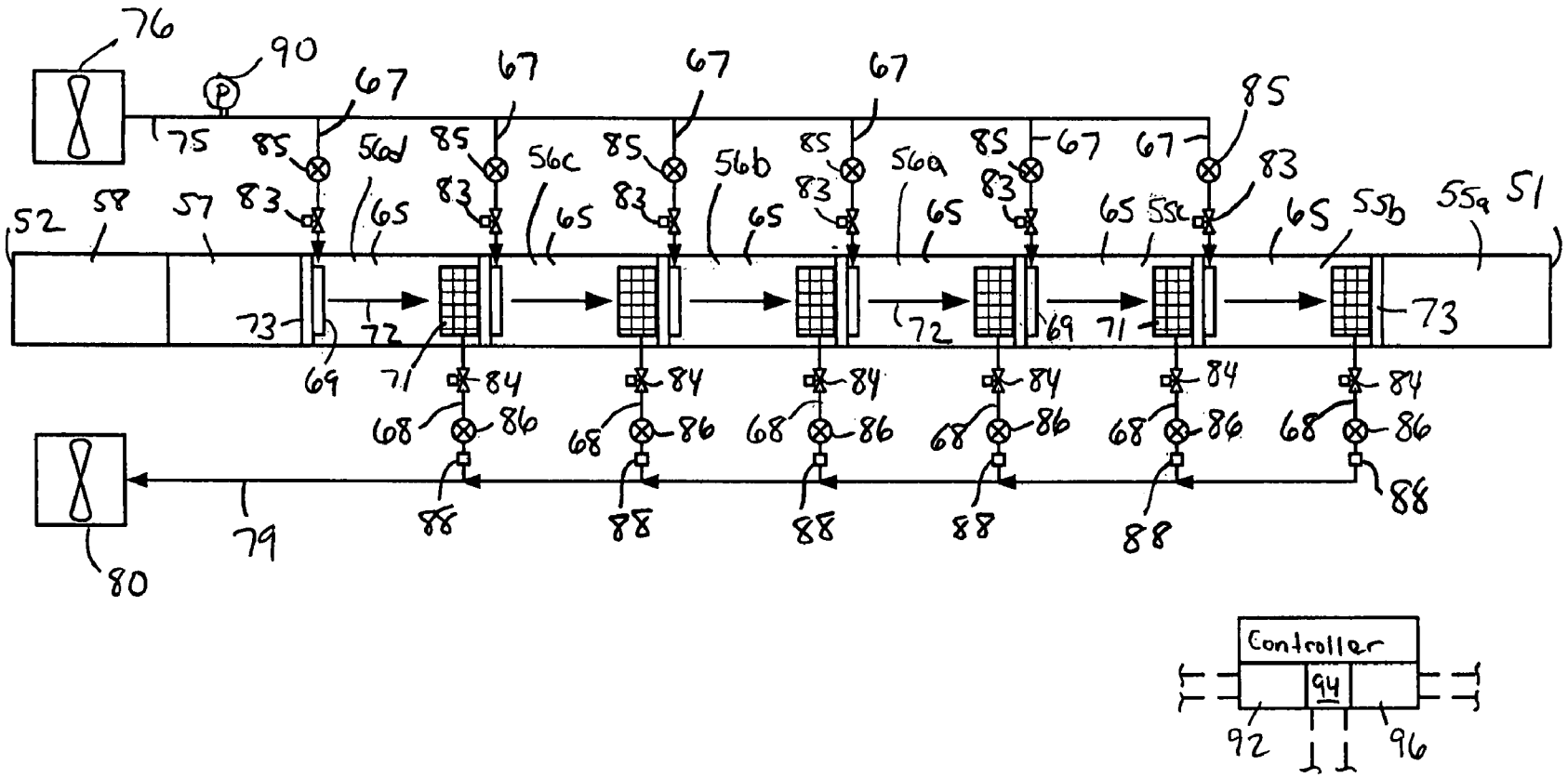
FIG. 3 is a schematic cross-sectional view taken along line 3-3 of FIG. 1 showing the under-car cooling system.

Burners 48 are mounted in the upper zone 37 of the tunnel kiln 1 in the sidewalls 16 and 17 or the roof 18 or both. The burners 48 are operated or controlled to adjust the temperature in the upper zone 37 of the tunnel kiln 1 to affect the desired curing of the bricks 11 or other items to be cured. As is indicated schematically in FIGS. 1 and 3, the tunnel kiln 1 is divided into multiple temperature control zones. One end of the tunnel kiln 1 includes an inlet 51 through which the kiln cars 5 initially enter the tunnel kiln 1. An outlet 52 is formed at the other end of the tunnel kiln 1. The remainder of the tunnel kiln 1 is divided into a preheat or warmup zone 55, a fire or firing zone 56, a transition zone 57 and a cooling zone 58 just prior to the outlet 52. It is to be understood that in some of the applications for the present invention, there may not be a zone referred to as the transition zone 57. As is also shown in FIG. 3, each zone, and in particular the firing zone 56 and the preheat zone 55 may each be divided into multiple sub-zones. The tunnel kiln 1 shown in FIG. 3 includes preheat zones 55*a*, 55*b* and 55*c* and firing zones 56*a*, 56*b*, 56*c* and 56*d*. It is noted that more sub-zones for the firing zone 56 and preheat zone 55 are shown in FIG. 3 than in FIG. 2.

The temperature control zones are generally distinguished by the presence or absence of burners 48 and the temperature to which the zone is heated and the effect of the resulting heating on the materials or bricks 11 passing therethrough. There generally are no burners 48 in the inlet zone. Burners 48 mounted in the preheat zones 55*a-c* are operated to increase the temperature of the bricks 11 as they travel toward the outlet 52. The bricks 11 are heated in the preheat zone to a temperature approaching the curing temperature for the ceramic material forming the bricks 11. Burners 48 mounted in the firing zones 56*a-d* are operated to maintain the temperature in the firing zones 56*a-d* at a temperature which results in curing of the ceramic material forming the bricks 11.

A primary blower or fan 61 is positioned near the inlet 51 of the tunnel kiln 1 and draws combustion and curing gasses out of the upper zone 37 of the tunnel kiln 1, along the length of the tunnel kiln 1 and out of the tunnel kiln 1 near the inlet 51. The air drawn into the tunnel kiln 1 from the outlet 52 cools the bricks 11 leaving the firing zones 56*a-d*. The hot combustion gasses also function to preheat the bricks 11 traveling through the preheat zones 55*a-c*. Because the primary blower 61 is located near the inlet 51, the negative pressure created thereby is greatest near the inlet 51 and decreases toward the outlet 52.

A stream of cooling air is circulated through the upper kiln tunnel channel 37 of the cooling zone 58 by a cooling zone supply fan 62 and a cooling zone exhaust fan 63. The transition zone 57 is formed between the cooling zone 58 and firing zone 56 to reduce the cross flow of heated air from the firing zone 56 to the cooling zone 58 or the cross flow of cooling air from the cooling zone 58 to the firing zone 56.

As discussed previously, the undercarriage cooling system 13 is adapted to cool the undercarriages 9 of each kiln car 5 and the rails 21 to prevent damage thereto which would hamper the ability of the kiln cars 5 to pass through the kiln tunnel 1. The undercarriage cooling system 13 functions to blow cooling air through portions of the lower kiln tunnel channel 38 corresponding to selected temperature control zones of the tunnel kiln 1 such as one or more of the firing zones 56*a-d* or the preheat zones 55*a-c* or both.

In the embodiment shown in FIGS. 2 and 3, cooling air flow paths or undercarriage cooling zones 65 are created in each of the firing zones 56*a-d* and the lattermost preheat zones 55*b-c*. Each undercarriage cooling zone 65 is created or formed by a supply duct 67 and an exhaust or return duct 68. Cooling air is directed out of the supply duct 67, across the associated zone 56*a-d* or 55*b-c* and drawn away through the return duct 68. As shown, a portion of the supply duct 67 may extend upward through the floor 15 of the kiln 1 and into the lower zone 38 thereof. A vent 69 is formed in the side of the supply duct 67 facing the return duct 68. The return duct 68 opens through the floor 15 of the kiln 1 on a side of the respective zone opposite the supply duct 67 and is covered by a grate 71. The supply duct 67 in each zone is located toward the outlet 52 of the kiln 1 and the exhaust duct 68 toward the inlet 51, such that the cooling air flows counter to the path of travel of the train 5 and in the same direction as air drawn through the upper zone 37 of the kiln 1. The path of travel of the cooling air is represented by arrows 72.

Air dams 73 are positioned behind or upstream (relative to the direction of airflow out of the supply duct 67) of each supply duct 67 and downstream of each exhaust duct 68. As shown, an air dam 73 extends between the exhaust duct 68 of one cooling air flow path 65 and the supply duct 67 of the adjacent cooling air flow path 65. The air dams 73 function to generally maintain the air flow from each paired supply duct 67 and exhaust duct 68 within the corresponding firing zone 56*a-d* or preheat zone 55*b-c* to cool the undercarriages 9 of the kiln cars 5 passing through those zones. It is foreseen that the portion of the supply ducts extending above the floor 15 of the kiln 1 could also function as an air dam and a separate air dam would not be required.

Each supply duct 67 branches off of and is connected to a main cooling air supply duct or supply trunk line 75. An air supply blower or fan 76 is connected to or mounted relative to the supply trunk line 75 to blow ambient air through the supply trunk line 75 and each supply duct 67 and toward the associated exhaust duct 68. Each exhaust duct 68 is flow connected to a main exhaust duct or exhaust trunk line 79. An exhaust fan 80 is connected to or mounted relative to the exhaust trunk line 79 to draw air through each of the exhaust ducts 68 and then the exhaust trunk line 79 and discharged through the fan 80.

Referring again to FIG. 3, a remotely controlled, adjustable supply damper 83 is positioned in each supply duct 67 and a remotely controlled, adjustable exhaust damper 84 is positioned in each exhaust duct 68. The degree of openness of the dampers 83 and 84 are is adjustable to vary the volumetric flow rate of air through the associated supply and exhaust ducts 67 and 68. A supply duct mass flow meter 85 is mounted in each supply duct 67 proximate the supply damper 83 and an exhaust duct mass flow meter 86 is mounted in each exhaust duct 68 for measuring the mass flow of air therethrough. A thermocouple or temperature transducer 88 is mounted in each exhaust duct 68 to measure the temperature of the exhaust air. In addition, a thermometer 89 with a visually readable scale or output may also be mounted to each exhaust duct 68 with its probe extending into the duct to allow visual inspection of the temperature of the exhaust air in each exhaust duct 68.

A pressure gauge or pressure transducer 90 is mounted or positioned in the main supply duct 75 to measure the pressure therein. The pressure transducer 90 communicates with a pressure PLC loop 92 which in turn controls the speed of the supply fan 76 in order to maintain a relatively constant air pressure in the main supply duct 75 and in each supply duct 67 up to the supply damper 83.

The thermocouples 88 in each exhaust duct 68 communicate with a temperature responsive PLC loop 94 which controls the degree of openness of the supply damper 83 to adjust the flow of cooling air through the supply duct 67, across the associated undercarriage cooling zone 65 and into the exhaust duct 68 to maintain the exhaust air from the undercarriage cooling zone 65 at a given set point, say 350° F. It is to be understood that the PLC could control the degree of openness of the supply damper 83 to adjust either the volumetric flow rate or mass flow rate of cooling air through the supply duct 67.

In the embodiment shown in FIG. 3, a flow responsive control loop 96 communicates with the supply and exhaust duct mass flow meters 85 and 86 and compares the measured mass flow rate of the cooling air for each paired supply duct 67 and exhaust duct 68. The mass flow meters 85 and 86 may comprise annubar or Pitot tube devices. If the supply and exhaust dampers 83 and 84 were maintained at the same degree of openness, the volumetric flow rate of cooling air through each would be the same. However, because the exhaust air is warmer than the supply air, the exhaust air is less dense and will have a lower mass flow rate than the supply air at the same volumetric flow rate. Therefore, the flow responsive control loop 96 adjusts the degree of openness of the associated exhaust damper 68 to equalize the mass flow rate of cooling air through the exhaust duct 68 with the measured mass flow rate of cooling air through the supply duct 67. It is to be understood that each control loop 92, 94 and 96 may be incorporated into a single controller.

Figure 6:
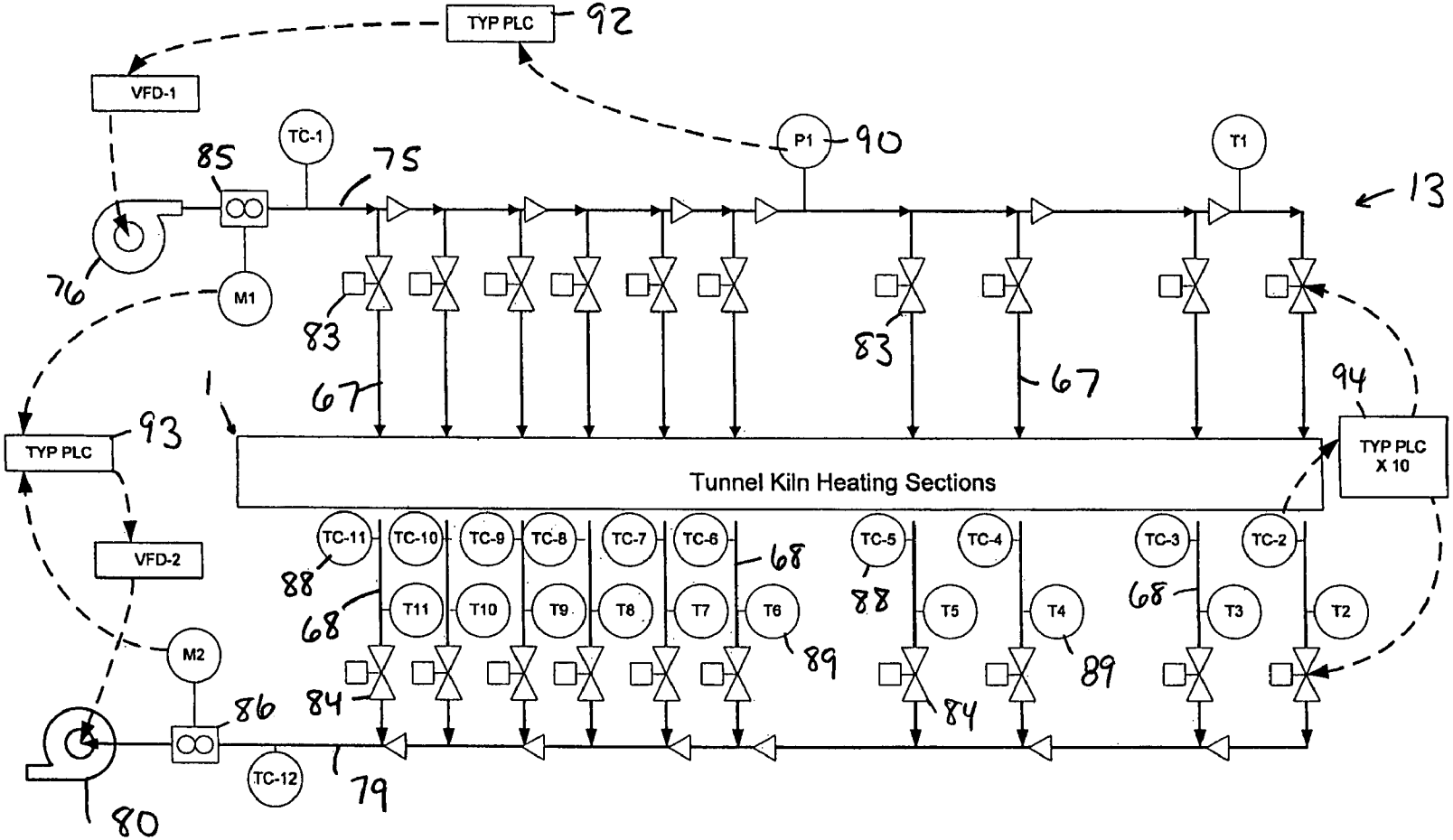
FIG. 6 is a schematic view of a tunnel kiln showing an alternative embodiment of the undercarriage cooling system.

In an alternative embodiment as generally shown in FIG. 6, a single supply mass flow meter 85 is mounted on or positioned in the main supply line 75 and a single exhaust mass flow meter 86 is mounted on or positioned in the main exhaust line 79. The degree of openness of the supply and exhaust dampers 83 and 84 is either maintained the same or at a specified proportionality. Instead of adjusting the degree of openness of the exhaust damper 84 relative to the associated supply damper 83, the flow responsive control loop 96 adjusts the speed of the exhaust fan 80 which will approximately balance out the mass flow rates for each matched pair of supply ducts 83 and exhaust ducts 84.

It is to be understood that a single supply damper and a single exhaust damper could be utilized to control the flow of air through multiple supply ducts and multiple exhaust ducts respectively. For example, in a modified version of the embodiment shown in FIG. 3, a single supply damper 83 could be positioned in a firing zone supply branch (not shown) to control the flow of cooling air to the supply ducts 67 associated with the air flow cooling paths 65 for each of the firing zones 56*a-d*. A single exhaust damper 84 positioned in a firing zone exhaust branch (not shown) would then be used to control the flow of cooling air drawn out of these zones 56*a-d* by the exhaust ducts 68. A mass flow meter would then be associated with both the firing zone supply branch and exhaust branch with a controller receiving measurements from these flow meters to adjust the degree of openness of the exhaust damper 84 to equalize the mass flow rate through the air flow cooling paths 65 of the firing zones 56*a-d*. A similar configuration could then be utilized for the air flow cooling paths 65 associated with each of the preheat zones 55*b-c* if appropriate.

It is also to be understood that the supply ducts 67 and exhaust ducts 68 forming each air flow cooling path 65 for the associated firing zones 56*a-d* or preheat zones 55*b-c* could be arranged on opposite sides of the respective zone as generally represented in the schematic diagram of FIG. 6. In such a configuration, the supply air is directed across the path of travel of the kiln cars 5. Air dams 73 would preferably still be utilized in such an embodiment positioned similarly to the arrangement shown in FIG. 3, to attempt to contain the cooling air for each air flow cooling path 65 within each of the respective zones 56*a-d* or 55*b-c*. Moreover, the number of air flow cooling paths 65 utilized can vary from as few as one. It is preferable to have at least one air flow cooling path 65 per the overall firing zone or preheat zone, and in most cases there will be multiple air flow cooling paths 65 for the overall firing zone and preheat zone.

By controlling and attempting to equalize the mass flow rates of cooling air through the supply duct 67 and exhaust duct 68 of each air flow cooling path 65, using the apparatus and methods described, the mass of the cooling air flowing into and out of each of the associated zones in the lower kiln tunnel channel 38 is generally equalized thereby avoiding the creation of an area of high or low pressure which would increase the amount of heated air or cooling air leaking between the upper kiln tunnel channel 37 and the lower kiln tunnel channel 38. Standard PLC programming functions can be used to set bias flow rates in individual zones in the lower kiln tunnel channel 38 to compensate for upper kiln tunnel channel pressures along the length of the kiln.

It is to be further understood that the apparatus and methodologies disclosed herein for use with a single track tunnel kiln 1 can be utilized for multi-track tunnel kilns. For a multi-track tunnel kiln additional air flow cooling paths 65 extending in end to end alignment could be utilized for each track. In a cross-flow application, it is foreseeable that a single air flow cooling path 65 could be formed across multiple tracks for corresponding zones with the supply duct positioned outside of a first track and an associated exhaust duct positioned on an opposite side of an adjacent track or with additional tracks spaced therebetween. However, for cooling efficiency, it is anticipated that each air flow cooling path 65 would only extend across a single track.

As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

It is to be understood that while certain forms of the present invention have been illustrated and described herein, it is not to be limited to the specific forms or arrangement of parts described and shown.

I claim:

1. A cooling system for cooling the underside of kiln cars located in a tunnel kiln wherein said tunnel kiln includes a floor, opposed side walls and a roof defining an elongated tunnel; a plurality of kiln cars connected together to form a train, each of said kiln cars including a deck on which uncured articles may be stacked for curing in said tunnel kiln, and an undercarriage supporting said deck in spaced relation to said tunnel kiln floor and facilitating passage of said train of kiln cars through said elongated tunnel; said deck sized to pass in close proximity to said side walls of said tunnel so as to define an upper kiln tunnel channel above said deck and a lower kiln tunnel channel below said deck; said tunnel having a pre-heat zone, a firing zone and a cooling zone; said cooling system comprises:

at least one cooling air supply duct and at least one cooling air exhaust duct opening into said lower kiln tunnel channel in an undercarriage cooling zone;

a cooling air supply blower connected to and blowing cooling air through said cooling air supply duct and into said undercarriage cooling zone;

a cooling air exhaust blower connected to said cooling air exhaust duct and drawing cooling air from said undercarriage cooling zone, through said cooling air exhaust duct;

a damper mounted in each of said cooling air supply duct and said cooling air exhaust duct;

a mass flow meter mounted relative to each of said cooling air supply duct and said cooling air exhaust duct for measuring the mass flow rate of air through each of said supply duct and said exhaust duct;

a temperature sensor mounted relative to said cooling air exhaust duct for measuring the temperature of air in said exhaust duct;

a controller receiving temperature measurements from said temperature sensor and adjusting the degree of openness of said cooling air supply duct damper to adjust the flow of cooling air into said lower kiln tunnel channel to drive the temperature therein toward a set point; said controller further comparing readings from said mass flow meters in said cooling air supply duct and said cooling air exhaust duct and adjusting the degree of openness of said damper in said cooling air exhaust duct to attempt to equalize the mass flow of cooling air through said cooling air exhaust duct with the mass flow of cooling air through said cooling air supply duct.

2. A cooling system for cooling the underside of kiln cars located in a tunnel kiln wherein said tunnel kiln includes a floor, opposed side walls and a roof defining an elongated tunnel; a plurality of kiln cars connected together to form a train, each of said kiln cars including a deck on which uncured articles may be stacked for curing in said tunnel kiln, and an undercarriage supporting said deck in spaced relation to said tunnel kiln floor and facilitating passage of said train of kiln cars through said elongated tunnel; said deck sized to pass in close proximity to said side walls of said tunnel so as to define an upper kiln tunnel channel above said deck and a lower kiln tunnel channel below said deck; wherein said tunnel having a pre-heat zone, a firing zone and a cooling zone; each of said pre-heat zone and said firing zone having a plurality of burners mounted in the upper kiln tunnel channel for increasing the temperature therein; said cooling system comprising:

at least one cooling air supply duct and at least one cooling air exhaust duct opening into said lower kiln tunnel channel in a plurality of undercarriage cooling zones; each said cooling air return duct associated with a respective one of said cooling air supply ducts;

each of said cooling air supply ducts flow connected to a cooling air supply trunk line; a cooling air supply blower connected to and blowing cooling air through said cooling air supply trunk, said cooling air supply ducts and into said undercarriage cooling zones;

each of said cooling air exhaust ducts flow connected to a cooling air exhaust trunk line; a cooling air exhaust blower connected to said cooling air exhaust trunk line and drawing cooling air from each of said undercarriage cooling zones, through said cooling air exhaust ducts and through said cooling air exhaust trunk line;

a damper mounted in each of said cooling air supply ducts and in each of said cooling air exhaust ducts a mass flow meter mounted relative to each of said cooling air supply ducts and each of said cooling air exhaust ducts;

a temperature sensor mounted relative to each of said cooling air return ducts;

a controller receiving temperature readings from said temperature sensors and adjusting the degree of openness of said cooling air supply duct damper in a respective cooling air supply duct to adjust the flow of cooling air into said respective undercarriage cooling zone to drive the temperature therein toward a set point for the respective undercarriage cooling zone; said controller further comparing measurements from said mass flow meters in said cooling air supply duct and said associated cooling air exhaust duct and adjusting the degree of openness of said damper in said cooling air exhaust duct to attempt to equalize the mass flow of cooling air through said cooling air exhaust duct with the mass flow of cooling air through said associated cooling air supply duct.

3. The cooling system as in claim 2 further comprising air dams positioned at each end of each undercarriage cooling zone to limit the flow of cooling air out of an undercarriage cooling zone.

4. The cooling system as in claim 2 wherein said undercarriage cooling zones extend lengthwise relative to said tunnel kiln.

5. The cooling system as in claim 2 wherein cooling air is directed from said supply duct to said exhaust duct in each of said undercarriage cooling zones in a direction opposite the direction of travel of said kiln car train.

6. The cooling system as in claim 2 wherein at least one of said undercarriage cooling zones is formed in said pre-heat zone and at least one of said undercarriage cooling zones is formed in said firing zone of said tunnel kiln.

7. A method of cooling the underside of kiln cars located in a tunnel kiln wherein said tunnel kiln includes a floor, opposed side walls and a roof defining an elongated tunnel; a plurality of kiln cars connected together to form a train, each of said kiln cars including a deck on which uncured articles may be stacked for curing in said tunnel kiln, and an undercarriage supporting said deck in spaced relation to said tunnel kiln floor and facilitating passage of said train of kiln cars through said elongated tunnel; said deck sized to pass in close proximity to said side walls of said tunnel so as to define an upper kiln tunnel channel above said deck and a lower kiln tunnel channel below said deck; said tunnel kiln having a pre-heat zone, a firing zone and a cooling zone; said method comprising the steps of:

directing cooling air into a portion of said lower kiln tunnel channel through a supply duct and exhausting cooling air from said portion of said lower kiln tunnel channel through an exhaust duct;

monitoring the temperature of the air exhausted through the exhaust duct;

adjusting the flow rate of cooling air through the supply duct to drive the temperature of the air exhausted through the exhaust duct toward a selected temperature;

monitoring the mass flow rate of cooling air through said supply duct and through said exhaust duct; and adjusting the mass flow rate of air through said exhaust duct to approach the mass flow rate of air through said supply duct.

8. A method of cooling the underside of kiln cars located in a tunnel kiln wherein said tunnel kiln includes a floor, opposed side walls and a roof defining an elongated tunnel; a plurality of kiln cars connected together to form a train, each of said kiln cars including a deck on which uncured articles may be stacked for curing in said tunnel kiln, and an undercarriage supporting said deck in spaced relation to said tunnel kiln floor and facilitating passage of said train of kiln cars through said elongated tunnel; said deck sized to pass in close proximity to said side walls of said tunnel so as to define an upper kiln tunnel channel above said deck and a lower kiln tunnel channel below said deck; said tunnel kiln having a pre-heat zone, a firing zone and a cooling zone; said method comprising the steps of:

directing cooling air into undercarriage cooling zones of said lower kiln tunnel channel through a supply duct associated with each undercarriage cooling zone and exhausting cooling air from said undercarriage cooling zones through an exhaust duct associated with each undercarriage cooling zone;

monitoring the temperature of the air exhausted through each exhaust duct;

adjusting the flow rate of cooling air through the supply duct associated with each exhaust duct to drive the temperature of the air exhausted through the exhaust duct toward a selected temperature;

monitoring the mass flow rate of cooling air through each said supply duct and through said associated exhaust duct; and adjusting the mass flow rate of air through each said exhaust duct to approach the mass flow rate of air through said associated supply duct.

* * * * *

UNITED STATES PATENT AND TRADEMARK OFFICE

CERTIFICATE OF CORRECTION

PATENT NO. : 7,950,921 B1
APPLICATION NO. : 12/176353
DATED : May 31, 2011
INVENTOR(S) : Rick L. Woolsey It is certified that error appears in the above-identified patent and that said Letters Patent is hereby corrected as shown below:

Claim 2, column 10, line 18, change “ducts a mass” to --ducts; a mass--.

Signed and Sealed this
Ninth Day of August, 2011

David J. Kappos

David J. Kappos
*Director of the United States Patent and Trademark Office*